US009970644B2

(12) United States Patent
Jang et al.

(10) Patent No.: US 9,970,644 B2
(45) Date of Patent: May 15, 2018

(54) LIGHTING DEVICE

(71) Applicant: LG INNOTEK CO., LTD., Seoul (KR)

(72) Inventors: Chul Ho Jang, Seoul (KR); Bo Hee Kang, Seoul (KR); Ki Hyun Kim, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days. days.

(21) Appl. No.: 15/633,294

(22) Filed: Jun. 26, 2017

(65) Prior Publication Data

US 2017/0343201 A1 Nov. 30, 2017

Related U.S. Application Data

(63) Continuation of application No. 15/096,992, filed on Apr. 12, 2016, now Pat. No. 9,719,671, which is a (Continued)

(30) Foreign Application Priority Data

Sep. 20, 2011 (KR) ..... 10-2011-0088970
Dec. 22, 2011 (KR) ..... 10-2011-0140134

(51) Int. Cl.
*F21V 33/00* (2006.01)
*F21V 29/503* (2015.01)
(Continued)

(52) U.S. Cl.
CPC ..... *F21V 29/503* (2015.01); *F21K 9/23* (2016.08); *F21K 9/232* (2016.08); *F21K 9/238* (2016.08);
(Continued)

(58) Field of Classification Search
CPC ..... F21K 9/135; F21V 23/006; F21V 29/22; F21V 29/77; F21V 29/777; F21V 3/00
See application file for complete search history.

(56) References Cited

U.S. PATENT DOCUMENTS 3,995,149 A 11/1976 Lukas
6,220,722 B1 4/2001 Begemann
(Continued)

FOREIGN PATENT DOCUMENTS

CN 201568889 U 9/2010
CN 101865372 A 10/2010
(Continued)

OTHER PUBLICATIONS

Korean Office Action dated Aug. 23, 2012 issued in Application No. 10-2011-0088970.
(Continued)

*Primary Examiner* — Ali Alavi
(74) *Attorney, Agent, or Firm* — KED & Associates LLP

(57) ABSTRACT

A lighting device may be provided that includes: a heat sink which includes a top surface and a member which has a side and is disposed on the top surface; a light source which includes a substrate disposed on the side of the member and light emitting devices disposed on the substrate, and has a reference point; and a cover which is coupled to the heat sink and includes an upper portion and a lower portion, which are divided by an imaginary plane passing through the reference point and being parallel with the top surface of the heat sink, wherein a distance from the reference point of the light source to the upper portion of the cover is larger than a distance from the reference point of the light source to the lower portion of the cover.

20 Claims, 20 Drawing Sheets

Related U.S. Application Data continuation of application No. 14/532,682, filed on Nov. 4, 2014, now Pat. No. 9,353,914, which is a continuation of application No. 13/583,752, filed as application No. PCT/KR2012/006995 on Aug. 31, 2012, now Pat. No. 8,905,580.

(51) Int. Cl.

| | |
|---|---|
| ***F21V 3/00*** | (2015.01) |
| ***F21V 23/00*** | (2015.01) |
| ***F21V 29/77*** | (2015.01) |
| ***F21V 29/70*** | (2015.01) |
| ***F21K 9/232*** | (2016.01) |
| ***F21V 3/04*** | (2018.01) |
| ***F21K 9/23*** | (2016.01) |
| ***F21K 9/238*** | (2016.01) |
| *F21Y 115/10* | (2016.01) |
| *F21Y 107/30* | (2016.01) |
| *F21Y 107/40* | (2016.01) |
| *F21Y 101/00* | (2016.01) |

(52) U.S. Cl.

CPC ..... *F21V 3/00* (2013.01); *F21V 3/0445* (2013.01); *F21V 23/006* (2013.01); *F21V 29/70* (2015.01); *F21V 29/77* (2015.01); *F21V 29/777* (2015.01); *F21Y 2101/00* (2013.01); *F21Y 2107/30* (2016.08); *F21Y 2107/40* (2016.08); *F21Y 2115/10* (2016.08)

(56) References Cited

U.S. PATENT DOCUMENTS

| | | | | |
|---|---|---|---|---|
| 6,332,690 | B1 | 12/2001 | Murofushi | |
| 6,634,770 | B2 | 10/2003 | Cao | |
| 6,719,446 | B2 | 4/2004 | Cao | |
| 7,901,107 | B2 | 3/2011 | Van De Ven | |
| 8,227,964 | B2 | 7/2012 | Choi et al. | |
| 8,511,862 | B2 | 8/2013 | Ishida | |
| 8,562,161 | B2 | 10/2013 | Tong et al. | |
| 8,698,290 | B2 | 4/2014 | Masumoto et al. | |
| 8,884,508 | B2 | 11/2014 | Pickard | |
| 8,905,580 | B2 | 12/2014 | Jang | |
| 9,353,914 | B2 | 5/2016 | Jang | |
| 2003/0039119 | A1* | 2/2003 | Cao | F21V 3/00 362/227 |
| 2006/0193130 | A1 | 8/2006 | Ishibashi | |
| 2007/0159828 | A1 | 7/2007 | Wang | |
| 2008/0037255 | A1* | 2/2008 | Wang | F21V 5/04 362/294 |
| 2008/0253125 | A1 | 10/2008 | Kang et al. | |
| 2009/0175041 | A1 | 7/2009 | Yuen et al. | |
| 2009/0195186 | A1 | 8/2009 | Guest et al. | |
| 2009/0316383 | A1 | 12/2009 | Son | |
| 2009/0321767 | A1 | 12/2009 | Shih et al. | |
| 2010/0103666 | A1* | 4/2010 | Chang | F21V 29/004 362/234 |
| 2010/0188838 | A1 | 7/2010 | Yajima | |
| 2010/0207502 | A1 | 8/2010 | Cao et al. | |
| 2010/0207534 | A1 | 8/2010 | Dowling | |
| 2010/0264799 | A1 | 10/2010 | Liu et al. | |
| 2011/0050070 | A1 | 3/2011 | Pickard | |
| 2011/0089830 | A1 | 4/2011 | Pickard | |
| 2011/0110096 | A1 | 5/2011 | Hong et al. | |
| 2011/0156584 | A1 | 6/2011 | Kim | |
| 2011/0169431 | A1 | 7/2011 | Li | |
| 2011/0194288 | A1 | 8/2011 | Hsu | |
| 2011/0215696 | A1 | 9/2011 | Tong et al. | |
| 2011/0215699 | A1 | 9/2011 | Le et al. | |
| 2011/0222280 | A1 | 9/2011 | Kim | |
| 2011/0234078 | A1 | 9/2011 | Choi et al. | |
| 2011/0248622 | A1 | 10/2011 | Wang | |
| 2011/0273072 | A1 | 11/2011 | Oki | |
| 2011/0291542 | A1* | 12/2011 | Lu | F21V 29/83 313/46 |
| 2011/0299269 | A1 | 12/2011 | Hata et al. | |
| 2012/0008328 | A1 | 1/2012 | Kobayashi et al. | |
| 2012/0049732 | A1 | 3/2012 | Chuang | |
| 2012/0051069 | A1 | 3/2012 | Lim | |
| 2012/0057327 | A1 | 3/2012 | Le et al. | |
| 2012/0069545 | A1 | 3/2012 | Choi et al. | |
| 2012/0268936 | A1 | 10/2012 | Pickard et al. | |
| 2012/0275165 | A1 | 11/2012 | Choi et al. | |
| 2012/0281405 | A1 | 11/2012 | Roth et al. | |
| 2012/0287636 | A1 | 11/2012 | Chen | |
| 2012/0326589 | A1 | 12/2012 | Yu | |
| 2013/0003346 | A1 | 1/2013 | Letoquin | |
| 2013/0153938 | A1 | 6/2013 | Grajcar | |
| 2013/0271972 | A1 | 10/2013 | Hussell | |
| 2013/0271981 | A1* | 10/2013 | Hussell | F21V 7/00 362/235 |
| 2014/0043823 | A1 | 2/2014 | Liu et al. | |
| 2014/0247606 | A1 | 9/2014 | Chen et al. | |
| 2015/0362168 | A1* | 12/2015 | Power | F21K 9/23 362/294 |
| 2016/0265728 | A1 | 9/2016 | Power | |

FOREIGN PATENT DOCUMENTS

| | | | |
|---|---|---|---|
| CN | 101922615 | A | 12/2010 |
| CN | 201688160 | U | 12/2010 |
| CN | 102003647 | | 4/2011 |
| CN | 102147068 | A | 8/2011 |
| CN | 102270629 | A | 12/2011 |
| CN | 102315370 | | 1/2012 |
| CN | 102384452 | A | 3/2012 |
| EP | 2056014 | A2 | 5/2009 |
| EP | 2 239 493 | A2 | 10/2010 |
| EP | 2 322 843 | A1 | 5/2011 |
| EP | 2 466 194 | A1 | 6/2012 |
| EP | 2 469 154 | A1 | 6/2012 |
| EP | 2 650 589 | A1 | 10/2013 |
| EP | 2 699 843 | A1 | 2/2014 |
| JP | 2006-244725 | | 9/2006 |
| JP | 2007-12288 | | 1/2007 |
| JP | 2007-012288 | A | 1/2007 |
| JP | 2007-48638 | A | 2/2007 |
| JP | 2009-289649 | | 12/2009 |
| JP | 2010-055993 | | 3/2010 |
| JP | 2010-055993 | A | 3/2010 |
| JP | 3163068 | | 9/2010 |
| JP | 2010-287343 | A | 12/2010 |
| JP | 3164963 | | 12/2010 |
| JP | 2011-96594 | A | 5/2011 |
| JP | 2011-159637 | A | 8/2011 |
| JP | 2011-175771 | | 9/2011 |
| JP | 3171093 | U | 9/2011 |
| JP | 2011-228300 | A | 11/2011 |
| JP | 2012-038691 | | 2/2012 |
| JP | 2012-099375 | A | 5/2012 |
| JP | 2012-181953 | | 9/2012 |
| JP | 5087671 | | 9/2014 |
| KR | 20-0447540 | Y1 | 1/2010 |
| KR | 20-0447540 | Y1 | 2/2010 |
| KR | 10-2010-0037353 | A | 4/2010 |
| KR | 10-0955037 | B1 | 4/2010 |
| KR | 10-2010-0127447 | A | 12/2010 |
| KR | 10-2011-0050904 | A | 5/2011 |
| KR | 10-2011-0104782 | A | 9/2011 |
| KR | 10-2011-0113544 | A | 10/2011 |
| KR | 10-2011-0117090 | A | 10/2011 |
| KR | 10-1080700 | B1 | 11/2011 |
| KR | 10-2011-0133386 | A | 12/2011 |
| KR | 10-2011-0135600 | A | 12/2011 |
| KR | 10-2012-0060447 | A | 6/2012 |
| KR | 10-1264213 | B1 | 5/2013 |
| WO | WO 00/17569 | A1 | 3/2000 |
| WO | WO 2010/038982 | A2 | 4/2010 |
| WO | WO 2011/087023 | A1 | 7/2011 |

(56) References Cited

FOREIGN PATENT DOCUMENTS

| | | |
|---|---|---|
| WO | WO 2011/105030 A1 | 9/2011 |
| WO | WO 2011/153456 | 12/2011 |

OTHER PUBLICATIONS

International Search Report dated Feb. 8, 2013 issued in Application No. PCT/KR2012/006995.
Korean Office Action dated Apr. 16, 2013 issued in Application No. 10-2011-0140134.
Korean Notice of Allowance dated Jul. 11, 2013 issued in Application No. 10-2011-0088970.
U.S. Office Action for greatgrandparent U.S. Appl. No. 13/583,752 dated Mar. 7, 2014.
Korean Search Report issued in application No. 10-2015-0012482 dated Feb. 4, 2015.
Korean Search Report issued in application No. 10-2012-0055594 dated Feb. 6, 2015.
European Search Report issued in application No. 12828129.2 dated Feb. 26, 2015.
European Search Report dated Apr. 4, 2013 issued in Application No. 13 15 2311.
European Search Report dated Jul. 4, 2013 issued in Application No. 13 15 3490.
U.S. Notice of Allowance dated Nov. 13, 2013 issued in U.S. Appl. No. 13/738,605.
European Office Action dated Mar. 21, 2014 issued in Application No. 13 153 490.1.
U.S. Office Action dated Oct. 30, 2014 issued in U.S. Appl. No. 13/754,676.
Chinese Office Action dated Apr. 23, 2015 issued in Application No. 1201280042711.4.
U.S. Notice of Allowance dated Apr. 29, 2015 issued in U.S. Appl. No. 13/754,676.
Korean Office Action dated May 28, 2015 issued in Application No. 10-2015-0012482.
Korean Office Action dated Jun. 17, 2015 issued in Application No. 10-2012-0055594.
European Search Report for Application No. 15165874.7 dated Jul. 30, 2015.
Chinese Office Action for Application 201310037557.8 dated Dec. 1, 2015 (and full English translation).
European Search Report for Application EP 15 17 8494 dated Dec. 16, 2015.
Japanese Office Action for Application 2014-528285 dated Feb. 23, 2016 and English translation.
U.S. Notice of Allowance dated Jan. 29, 2016 issued in grandparent U.S. Appl. No. 14/532,682.
U.S. Office Action issued in copending U.S. Appl. No. 14/721,832 dated Jan. 23, 2017.
Japanese Office Action dated Jan. 10, 2017 issued in Application No. 2013-053707.
Chinese Office Action dated Jan. 17, 2017 issued in Application No. 201310072511.X (with English translation).
Chinese Office Action dated Feb. 24, 2017 issued in Application No. 201310037557.8 (with English translation).
U.S. Office Action issued in parent U.S. Appl. No. 15/096,992 dated Jan. 27, 2017.
U.S. Notice of Allowance issued in parent U.S. Appl. No. 15/096,992 dated Mar. 27, 2017.

* cited by examiner

Appendix B: Diagram of Omnidirectional Lamp Zones

Omnidirectional lamp in base-up position

【Figure 13】
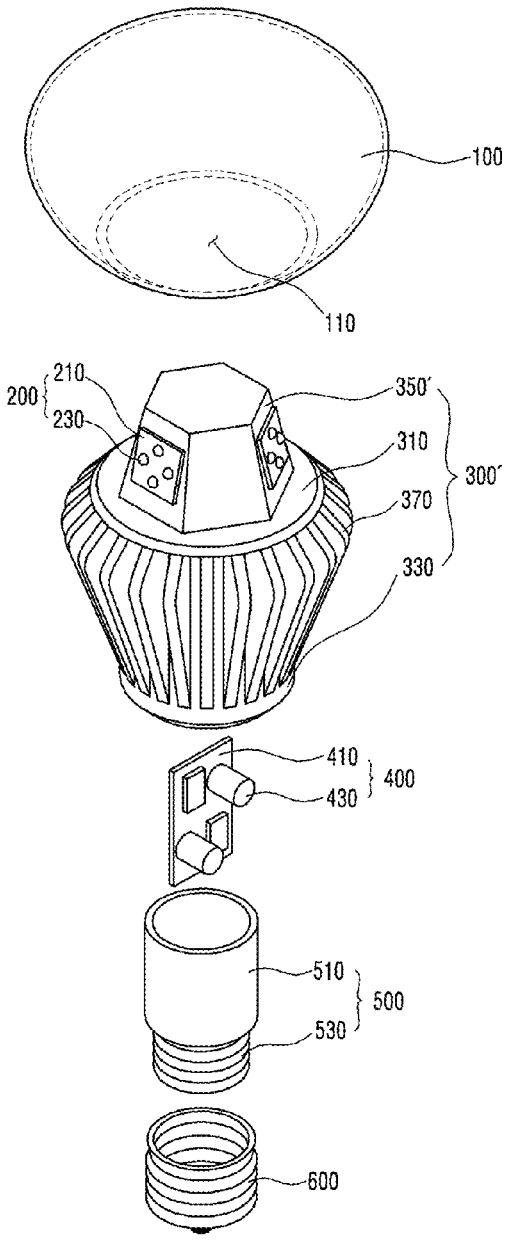

【Figure 14】
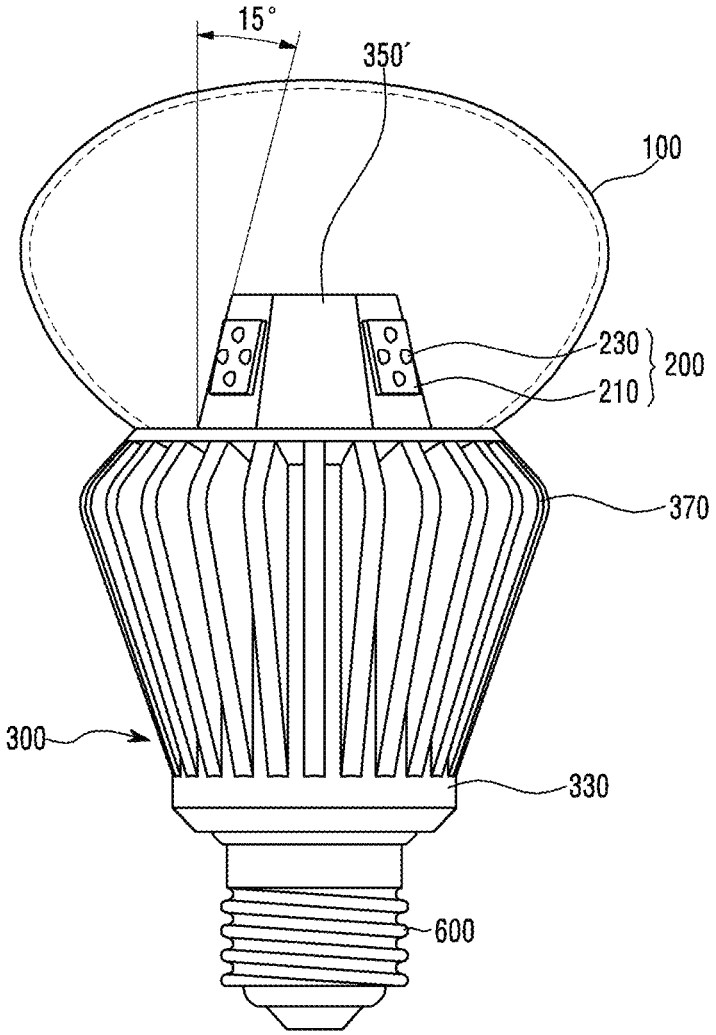

【Figure 15】
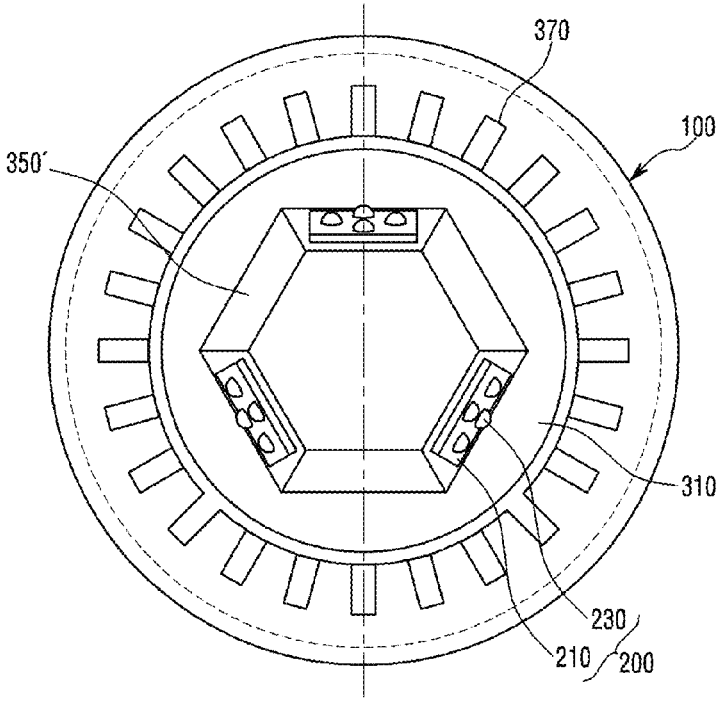
【Figure 16】
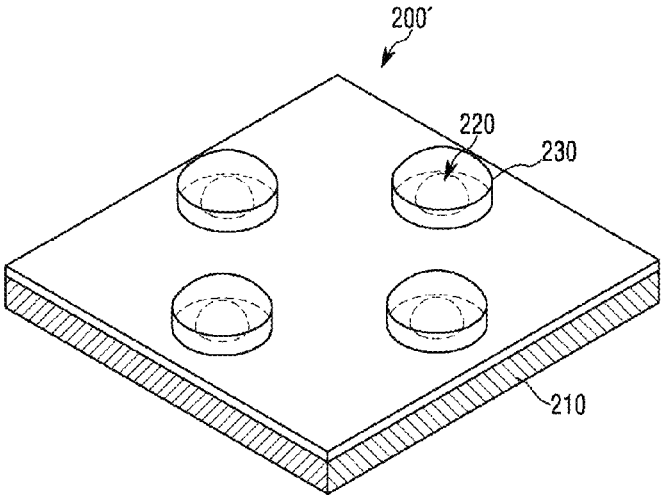

【Figure 17】
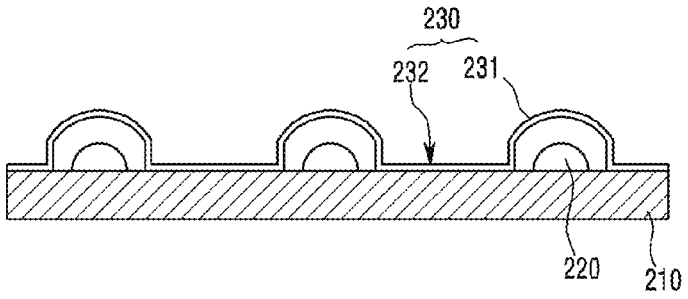
【Figure 18】
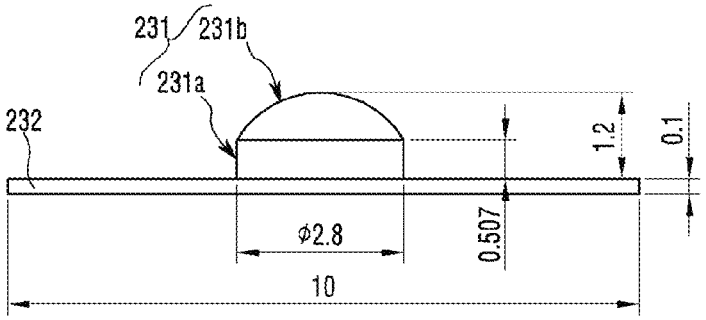

【Figure 19】
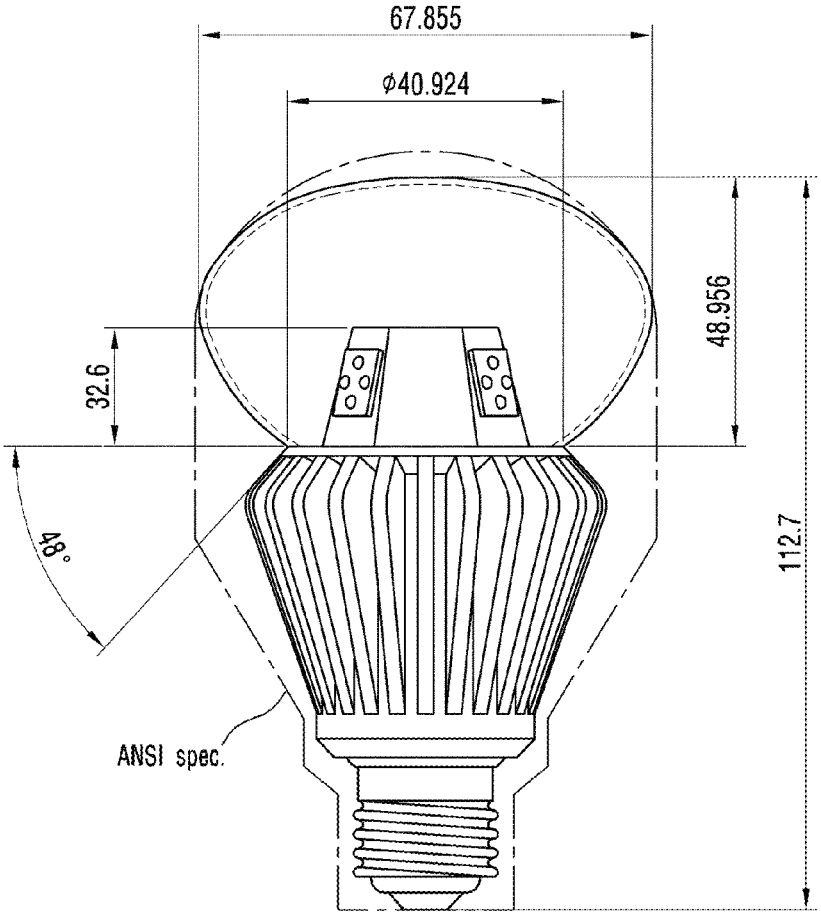

【Figure 20】
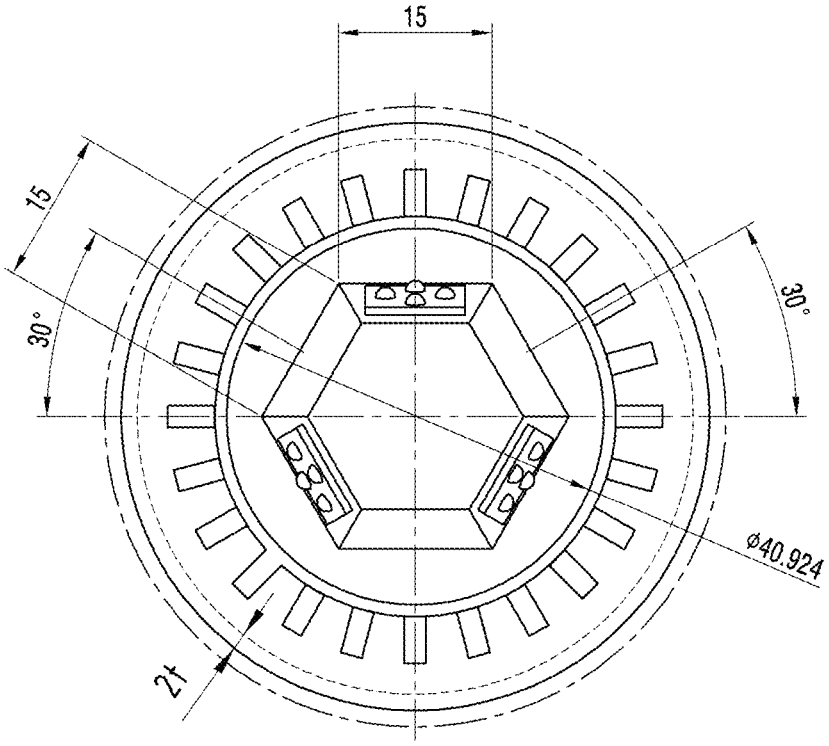

LIGHTING DEVICE

CROSS-REFERENCE TO RELATED APPLICATIONS

The present application is a Continuation Application of U.S. application Ser. No. 15/096,992, filed Apr. 12, 2016, which is a Continuation Application of U.S. application Ser. No. 14/532,682, filed Nov. 4, 2014, which is a Continuation Application of U.S. application Ser. No. 13/583,752 filed Sep. 10, 2012 (now U.S. Pat. No. 8,905,580), which claims priority from PCT Application No. PCT/KR2012/006995 filed Aug. 31, 2012, which claims priority to Korean Patent Application No. 10-2011-0088970, filed Sep. 2, 2011, and No. 10-2011-0140134, filed Dec. 22, 2011, the entireties of which are incorporated herein by reference.

BACKGROUND

1. Field

This embodiment relates to a lighting device.

2. Background

A light emitting diode (LED) is a semiconductor element for converting electric energy into light. As compared with existing light sources such as a fluorescent lamp and an incandescent electric lamp and so on, the LED has advantages of low power consumption, a semi-permanent span of life, a rapid response speed, safety and an environment-friendliness. For this reason, many researches are devoted to substitution of the existing light sources with the LED. The LED is now increasingly used as a light source for lighting devices, for example, various lamps used interiorly and exteriorly, a liquid crystal display device, an electric sign and a street lamp and the like.

Technical Problem

The objective of the present invention is to provide a lighting device capable of providing a rear light distribution.

The objective of the present invention is to provide a lighting device capable of satisfying ANSI specifications.

The objective of the present invention is to provide a lighting device capable of satisfying Energy Star specifications.

The objective of the present invention is to provide a lighting device capable of satisfying U.S. rear light distribution regulations (Energy Star specifications) and ANSI specifications and of remarkably improving rear light distribution characteristic and removing a dark portion by disposing a member of which a side is inclined at a predetermined angle on a heat sink, by disposing a light source on the side of the member, and by disposing a lens over a light emitting device of the light source.

The objective of the present invention is to provide a lighting device capable of obtaining a rear light distribution design technology.

Technical Solution

One embodiment is a lighting device. The lighting device includes: a heat sink which includes a top surface and a member which has a side and is disposed on the top surface; a light source which includes a substrate disposed on the side of the member and light emitting devices disposed on the substrate, and has a reference point; and a cover which is coupled to the heat sink and includes an upper portion and a lower portion, which are divided by an imaginary plane passing through the reference point and being parallel with the top surface of the heat sink. A distance from the reference point of the light source to the upper portion of the cover is larger than a distance from the reference point of the light source to the lower portion of the cover.

The distance from the reference point of the light source to the upper portion of the cover is larger than a distance from the reference point of the light source to the top surface of the heat sink.

The distance from the reference point of the light source to the lower portion of the cover is less than a distance from the reference point of the light source to the top surface of the heat sink.

The reference point of the light source is a center point among the light emitting devices or a center point of the substrate.

The member is a polygonal pillar having a plurality of the sides.

The polygonal pillar is a hexagonal pillar.

The light source is disposed on three out of six sides of the hexagonal pillar.

The sides of the polygonal pillar are substantially perpendicular to the top surface of the heat sink.

An angle between the side of the member and a tangent line which passes through the reference point of the light source and contacts with a side of the heat sink is greater than and not equal to 0° and equal to or less than 45°.

The heat sink includes a heat radiating fin extending from the side of the heat sink. An angle between the side of the member and a tangent line which passes through the reference point of the light source and contacts with the heat radiating fin is greater than and not equal to 0° and equal to or less than 45°.

The heat sink includes a cross section formed by the heat sink along an imaginary plane including one side of the substrate. An angle between a vertical axis of the imaginary plane and a straight line which passes through the reference point of the light source and contacts with the cross section is greater than and not equal to 0° and equal to or less than 45°.

The heat sink includes a receiver. The heat sink includes an inner case which is disposed in the receiver and a circuitry which disposed in the inner case and is received in the receiver.

An angle between the top surface of the heat sink and the side of the member is an obtuse angle.

An angle between the side of the member and an imaginary axis perpendicular to the top surface of the heat sink is an acute angle.

The member is a polygonal pillar or a cone of which the area of the bottom surface is greater than that of the top surface.

The light source includes a lens which is disposed on the light emitting device and of which the beam angle is greater than 150°, and a lens unit which is integrally formed with the lens and includes a bottom plate disposed on the substrate.

The lens unit further includes a reflective layer disposed on the bottom plate.

The lens is an aspheric lens or a primary lens.

Another embodiment is a lighting device. The lighting device includes: a heat sink which includes a top surface and a member which has a side and is disposed on the top surface; a light source which includes a substrate disposed on the side of the member and light emitting devices disposed on the substrate, and has a center point; and a cover which is coupled to the heat sink. An angle between the side of the member and a tangent line which passes through the center point and contacts with the side of the heat sink is greater than and not equal to 0° and equal to or less than 45°.

Further another embodiment is a lighting device. The lighting device includes: a heat sink which includes a top surface and a member which has a side and is disposed on the top surface; a light source which includes a substrate disposed on the side of the member, light emitting devices disposed on the substrate, and a lens unit disposed on the light emitting devices; and a cover which is coupled to the heat sink. The lens unit includes a lens of which the beam angle is greater than 150° and a bottom plate which is integrally formed with the lens and is disposed on the substrate.

Advantageous Effects

A lighting device in accordance with the present invention is capable of providing a rear light distribution.

A lighting device in accordance with the present invention is capable of satisfying ANSI specifications.

A lighting device in accordance with the present invention is capable of satisfying Energy Star specifications.

A lighting device in accordance with the present invention is capable of satisfying U.S. rear light distribution regulations (Energy Star specifications) and ANSI specifications and of remarkably improving rear light distribution characteristic and removing a dark portion by disposing a member of which a side is inclined at a predetermined angle on a heat sink, by disposing a light source on the side of the member, and by disposing a lens on a light emitting device of the light source.

A lighting device in accordance with the present invention is capable of obtaining a rear light distribution design technology.

BRIEF DESCRIPTION OF THE DRAWINGS

The embodiments will be described in detail with reference to the following drawings in which like reference numerals refer to like elements wherein:

FIG. 13 is an exploded perspective view of a lighting device according to a second embodiment;

FIG. 14 is a front view of the lighting device shown in FIG. 13;

FIG. 15 is a plan view of the lighting device shown in FIG. 13;

FIG. 16 is a perspective view of a light source shown in FIGS. 2 and 13;

FIG. 17 is a side view of the light source shown in FIG. 16;

FIG. 18 is a view showing an example of measured values of a lens shown in FIG. 17;

FIG. 19 is a front view of the lighting device shown in FIG. 13;

FIG. 20 is a plan view of the lighting device shown in FIG. 13;

DETAILED DESCRIPTION

A thickness or size of each layer is magnified, omitted or schematically shown for the purpose of convenience and clearness of description. The size of each component does not necessarily mean its actual size.

In description of embodiments of the present invention, when it is mentioned that an element is formed "on" or "under" another element, it means that the mention includes a case where two elements are formed directly contacting with each other or are formed such that at least one separate element is interposed between the two elements. The "on" and "under" will be described to include the upward and downward directions based on one element.

Hereafter, a lighting device according to an embodiment will be described with reference to the accompanying drawings.

First Embodiment

Figure 1:
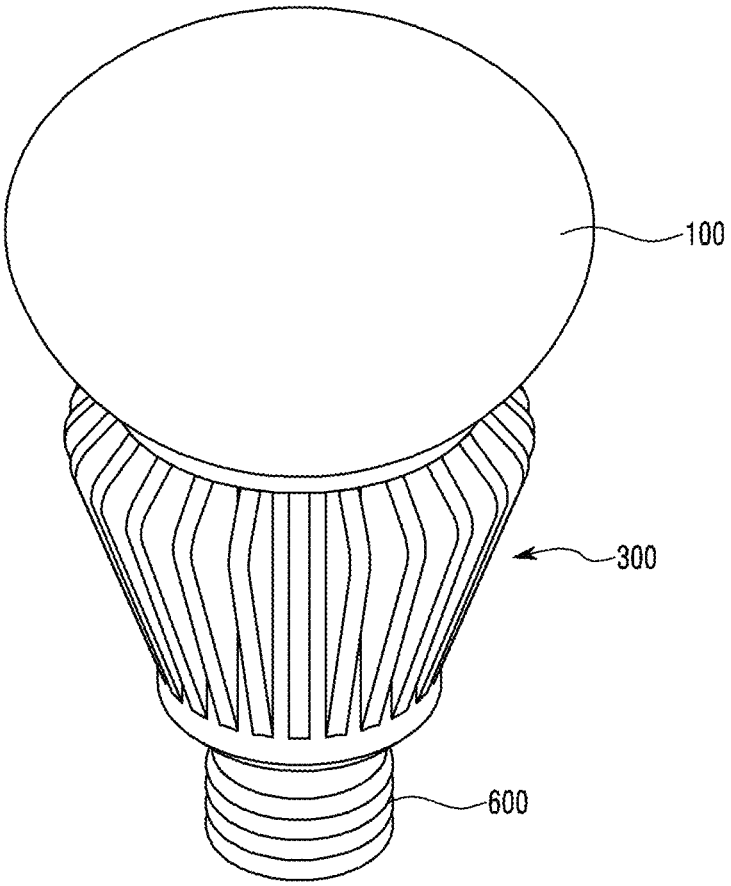
FIG. 1 is a perspective view of a lighting device according to a first embodiment.
Figure 2:
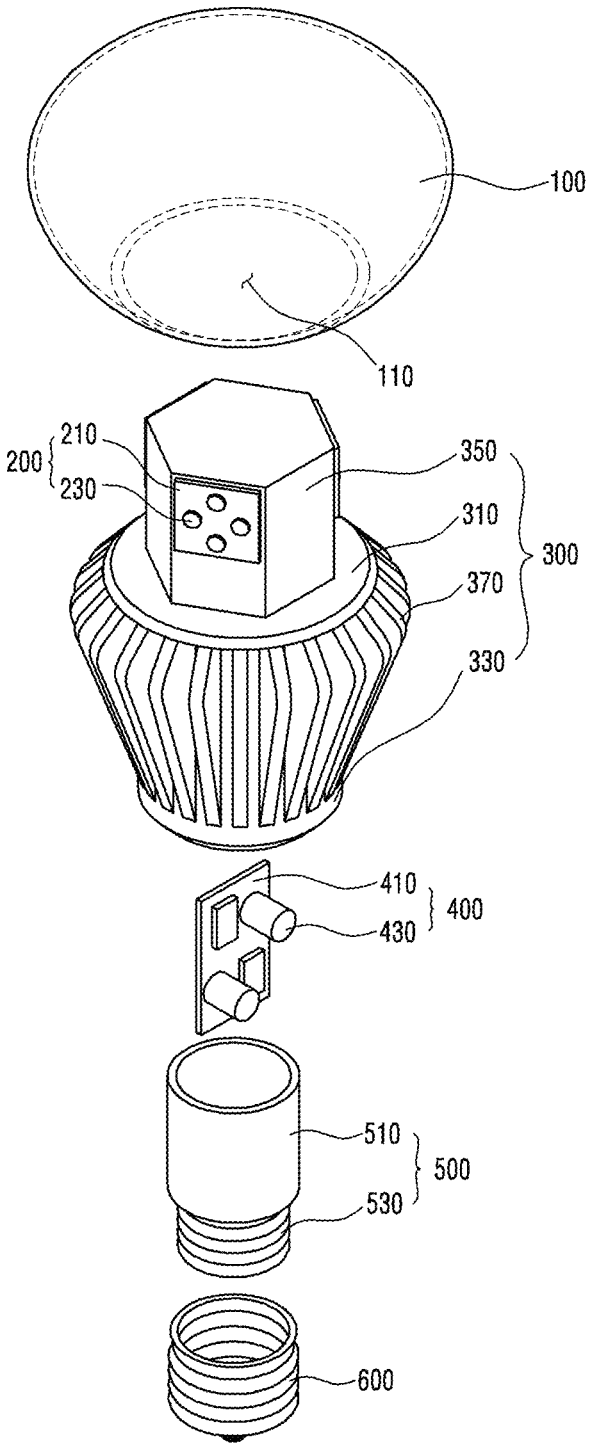
FIG. 2 is an exploded perspective view of the lighting device shown in FIG. 1.

FIG. 1 is a perspective view of a lighting device according to a first embodiment. FIG. 2 is an exploded perspective view of the lighting device shown in FIG. 1.

Referring to FIGS. 1 and 2, the lighting device according to the first embodiment may include a cover 100, a light source 200, a heat sink 300, a circuitry 400, an inner case 500 and a socket 600. Hereafter, respective components will be described in detail.

The cover 100 has a bulb shape with an empty interior. The cover 100 has an opening 110. The opening 110 may be formed in the lower portion of the cover 100. A member 350 and the light source 200 are inserted into the opening 110.

The cover 100 includes an upper portion corresponding to the lower portion thereof, and a central portion between the lower portion and the upper portion. The diameter of the opening 110 of the lower portion may be equal to or less than that of the top surface 310 of the heat sink 300. The diameter of the central portion may be larger than that of the top surface 310 of the heat sink 300.

The cover 100 is coupled to the heat sink 300 and surrounds the light source 200 and the member 350. The light source 200 and the member 350 are isolated from the outside by the coupling of the cover 100 and the heat sink 300. The cover 100 may be coupled to the heat sink 300 by using an adhesive or various methods, for example, rotary coupling, hook coupling and the like. In the rotary coupling method, the screw thread of the cover 100 is coupled to the screw groove of the heat sink 300. That is, the cover 100 and the heat sink 300 are coupled to each other by the rotation of the cover 100. In the hook coupling method, the cover 100 and the heat sink 300 are coupled to each other by inserting and fixing a protrusion of the cover 100 into the groove of the heat sink 300.

The cover 100 is optically coupled to the light source 200. Specifically, the cover 100 may diffuse, scatter or excite light emitted from a light emitting device 230 of the light source 200. Here, the inner/outer surface or the inside of the cover 100 may include a fluorescent material so as to excite the light emitted from the light source 200.

The inner surface of the cover 100 may be coated with an opalescent pigment. Here, the opalescent pigment may include a diffusing agent diffusing the light. The roughness of the inner surface of the cover 100 may be larger than that of the outer surface of the cover 100. This intends to sufficiently scatter and diffuse the light emitted from the light source 200.

The cover 100 may be formed of glass, plastic, polypropylene (PP), polyethylene (PE), polycarbonate (PC) and the like. Here, the polycarbonate (PC) has excellent light resistance, thermal resistance and rigidity.

The cover 100 may be formed of a transparent material causing the light source 200 and the member 350 to be visible to the outside or may be formed of an opaque material causing the light source 200 and the member 350 not to be visible to the outside. The cover 100 may include a reflective material reflecting at least a part of the light emitted from the light source 200 toward the heat sink 300.

The cover 100 may be formed by a blow molding process.

A plurality of the light sources 200 may be disposed on the member 350 of the heat sink 300. Specifically, the light source 200 may be disposed on at least one of a plurality of sides of the member 350. The light source 200 may be disposed on the upper portion of the side of the member 350.

In FIG. 2, the light source 200 is disposed on three out of six sides of the member 350. However, there is no limit to this. The light source 200 may be disposed on all of the sides of the member 350.

The light source 200 may include a substrate 210 and the light emitting device 230. The light emitting device 230 is disposed on one side of the substrate 210.

The substrate 210 may have a quadrangular plate shape. However, the substrate 210 may have various shapes without being limited to this. For example, the substrate 210 may have a circular plate shape or a polygonal plate shape. The substrate 210 may be formed by printing a circuit pattern on an insulator. For example, the substrate 210 may include a common printed circuit board (PCB), a metal core PCB, a flexible PCB, a ceramic PCB and the like. Also, the substrate 210 may include a chips on board (COB) allowing an unpackaged LED chip to be directly bonded to a printed circuit board. The substrate 210 may be formed of a material capable of efficiently reflecting light. The surface of the substrate 210 may have a color such as white, silver and the like capable of efficiently reflecting light. The surface of the substrate 210 may be formed of a material capable of efficiently reflecting light. The surface of the substrate 210 may be coated with a color capable of efficiently reflecting light, for example, white, silver and the like. For example, the surface of the substrate 210 may have a reflectance greater than 78% with respect to light reflected by the surface of the substrate 210.

The surface of the substrate 210 may be coated with a material capable of efficiently reflecting light. The surface of the substrate 210 may be coated with a color capable of efficiently reflecting light, for example, white, silver and the like.

The substrate 210 is electrically connected to the circuitry 400 received in the heat sink 300. The substrate 210 may be connected to the circuitry 400 by means of a wire. The wire passes through the heat sink 300 and connects the substrate 210 with the circuitry 400.

The light emitting device 230 may be a light emitting diode chip emitting red, green and blue light or a light emitting diode chip emitting UV. Here, the light emitting diode chip may have a lateral type or vertical type and may emit blue, red, yellow or green light.

The light emitting device 230 may have a fluorescent material. The fluorescent material may include at least any one selected from a group consisting of a garnet material (YAG, TAG), a silicate material, a nitride material and an oxynitride material. Otherwise, the fluorescent material may include at least any one selected from a group consisting of a yellow fluorescent material, a green fluorescent material and a red fluorescent material.

In the lighting device according to the first embodiment, the size of the light emitting device 230 is 1.3×1.3×0.1 (mm). A blue LED chip and an LED chip having the yellow fluorescent material.

The heat sink 300 is coupled to the cover 100 and radiates heat from the light source 200.

The heat sink 300 has a predetermined volume and may include a top surface 310, a side 330, a bottom surface (not shown) and the member 350.

The member 350 is disposed on the top surface 310. The top surface 310 may be coupled to the cover 100. The top surface 310 may have a shape corresponding to the opening 110 of the cover 100.

A plurality of heat radiating fins 370 may be disposed on the side 330. The heat radiating fin 370 may extend outwardly from the side 330 of the heat sink 300 or may be connected to the side 330 of the heat sink 300. The heat radiating fin 370 is able to improve heat radiation efficiency by increasing the heat radiating area of the heat sink 300. Here, the heat radiating fins 370 may not be disposed on the side 330.

At least a portion of the heat radiating fins 370 may have a side having a predetermined inclination. Here, the inclination may be from 45° to 90° on the basis of an imaginary line parallel with the top surface 310. On the other hand, the side 330 itself may have a predetermined inclination without the heat radiating fin 370. That is, the side 330 without the heat radiating fin 370 may be inclined at an angle of from 45° to 90° on the basis of an imaginary line parallel with the top surface 310.

The bottom surface (not shown) may have a receiver (not shown) receiving the circuitry 400 and the inner case 500.

The member 350 is disposed on the top surface 310 of the heat sink 300. The member 350 may be integrally formed with the top surface 310 or may be coupled to the top surface 310.

The member 350 may have a polygonal pillar shape. Specifically, the member 350 may be a hexagonal pillar shape. The hexagonal pillar-shaped member 350 has a top surface, a bottom surface and six sides. Here, the member 350 may have not only the polygonal pillar shape but also a cylindrical shape or an elliptical shape. When the member 350 has the cylindrical shape or the elliptical shape, the substrate 210 of the light source 200 may be a flexible substrate.

The light source 200 may be disposed on the six sides of the member 350. The light source 200 may be disposed on all or some of the six sides. FIG. 2 shows that the light source 200 is disposed on three out of the six sides.

The substrate 210 is disposed on the side of the member 350. The side of the member 350 may be substantially perpendicular to the top surface 310 of the heat sink 300. Therefore, the substrate 210 may be substantially perpendicular to the top surface 310 of the heat sink 300.

The material of the member 350 may have thermal conductivity. This intends to receive rapidly the heat generated from the light source 200. The material of the member 350 may include, for example, Al, Ni, Cu, Mg, Ag, Sn and the like and an alloy including the metallic materials. The member 350 may be also formed of thermally conductive plastic. The thermally conductive plastic is lighter than a metallic material and has a unidirectional thermal conductivity.

The heat sink 300 may have a receiver (not shown) receiving the circuitry 400 and the inner case 500.

The circuitry 400 receives external electric power, and then converts the received electric power in accordance with the light source 200. The circuitry 400 supplies the converted electric power to the light source 200.

The circuitry 400 is received in the heat sink 300. Specifically, the circuitry 400 is received in the inner case 500, and then, together with the inner case 500, is received in the receiver (not shown) of the heat sink 300.

The circuitry 400 may include a circuit board 410 and a plurality of parts 430 mounted on the circuit board 410.

The circuit board 410 may have a circular plate shape. However, the circuit board 410 may have various shapes without being limited to this. For example, the circuit board 410 may have an elliptical plate shape or a polygonal plate shape. The circuit board 410 may be formed by printing a circuit pattern on an insulator.

The circuit board 410 is electrically connected to the substrate 210 of the light source 200. The circuit board 410 may be electrically connected to the substrate 210 by using a wire. That is, the wire is disposed within the heat sink 300 and may connect the circuit board 410 with the substrate 210.

The plurality of the parts 430 may include, for example, a DC converter converting AC power supply supplied by an external power supply into DC power supply, a driving chip controlling the driving of the light source 200, and an electrostatic discharge (ESD) protective device for protecting the light source 200.

The inner case 500 receives the circuitry 400 thereinside. The inner case 500 may have a receiver 510 for receiving the circuitry 400. The receiver 510 may have a cylindrical shape. The shape of the receiver 510 may be changed according to the shape of the receiver (not shown) of the heat sink 300.

The inner case 500 is received in the heat sink 300. The receiver 510 of the inner case 500 is received in the receiver (not shown) formed in the bottom surface (not shown) of the heat sink 300.

The inner case 500 is coupled to the socket 600. The inner case 500 may include a connection portion 530 which is coupled to the socket 600. The connection portion 530 may have a screw thread corresponding to a screw groove of the socket 600.

The inner case 500 is a nonconductor. Therefore, the inner case 500 prevents electrical short-cut between the circuitry 400 and the heat sink 300. The inner case 500 may be made of a plastic or resin material.

The socket 600 is coupled to the inner case 500. Specifically, the socket 600 is coupled to the connection portion 530 of the inner case 500.

The socket 600 may have the same structure as that of a conventional incandescent bulb. The circuitry 400 is electrically connected to the socket 600. The circuitry 400 may be electrically connected to the socket 600 by using a wire. Therefore, when external electric power is applied to the socket 600, the external electric power may be transmitted to the circuitry 400.

The socket 600 may have a screw groove corresponding to the screw thread of the connection portion 530.

The lighting device shown in FIGS. 1 and 2 is able to satisfy the requirements of ANSI specifications. This will be described with reference to FIGS. 3 to 4.

Figure 3:
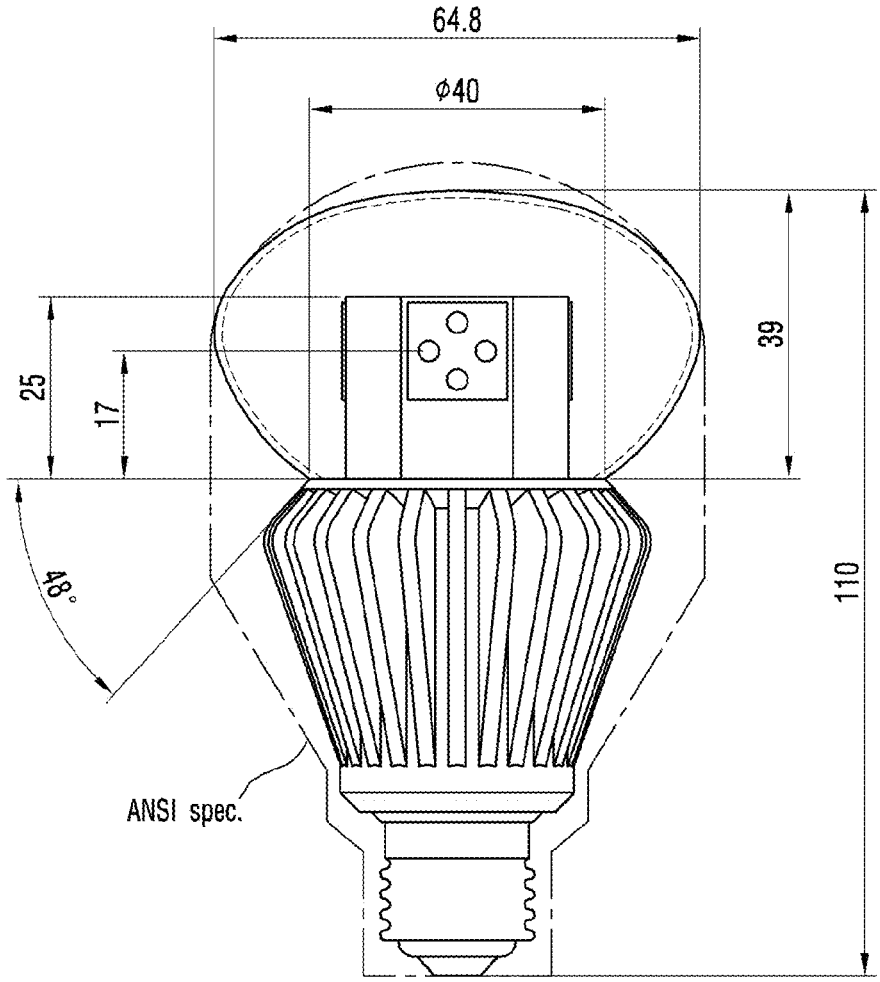
FIG. 3 is a front view of the lighting device shown in FIG. 1.
Figure 4:
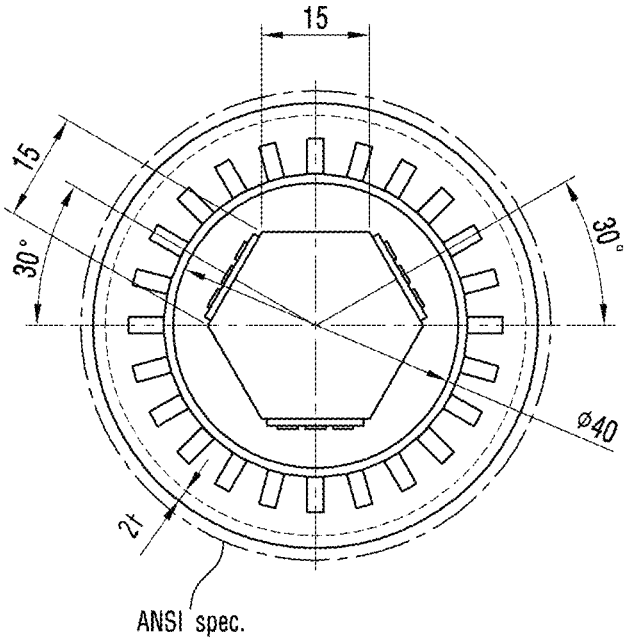
FIG. 4 is a plan view of the lighting device shown in FIG. 1.

FIG. 3 is a front view of the lighting device shown in FIG. 1. FIG. 4 is a plan view of the lighting device shown in FIG. 1.

ANSI specifications have specified norms or standards for U.S. industrial products. ANSI specifications also provide standards for products like the lighting device shown in FIGS. 1 and 2.

Referring to FIGS. 3 and 4, it can be found that the lighting device according to the first embodiment satisfies ANSI specifications. A unit of millimeter (mm) is used in FIGS. 3 to 4.

Meanwhile, Energy Star specifications stipulate that a lighting device or a lighting apparatus should have a predetermined luminous intensity distribution.

Figure 5:
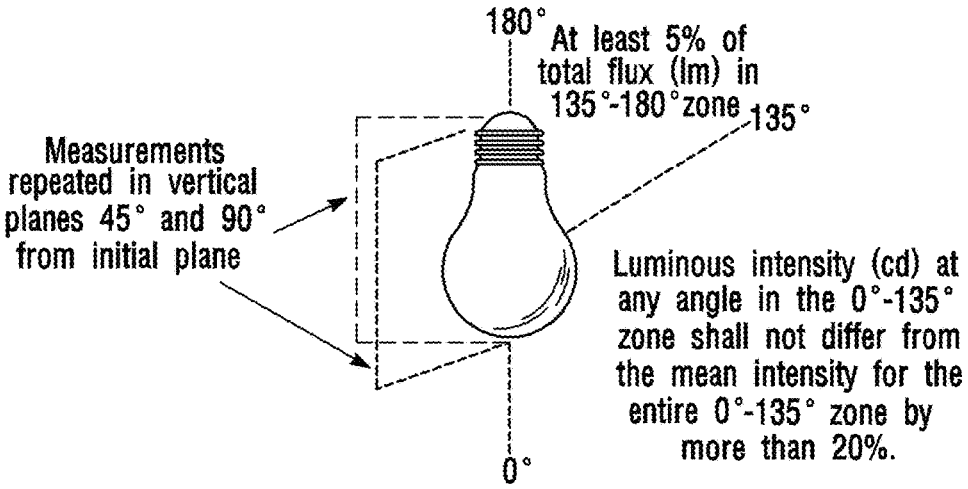
FIG. 5 is a view for describing luminous intensity distribution requirements of an omni-directional lamp in Energy Star specifications.

FIG. 5 shows luminous intensity distribution requirements of an omni-directional lamp in Energy Star specifications.

Particularly, referring to Energy Star specifications shown in FIG. 5, Energy Star specifications include a requirement that at least 5% of the total flux (lm) of a lighting device should be emitted in 135° to 180° zone of the lighting device.

The lighting device shown in FIGS. 1 and 2 is able to satisfy Energy Star specifications shown in FIG. 5, and in particular, to satisfy the requirement that at least 5% of the total flux (lm) of the lighting device should be emitted in 135° to 180° zone of the lighting device. This will be described with reference to FIGS. 6 to 10.

Figure 6:
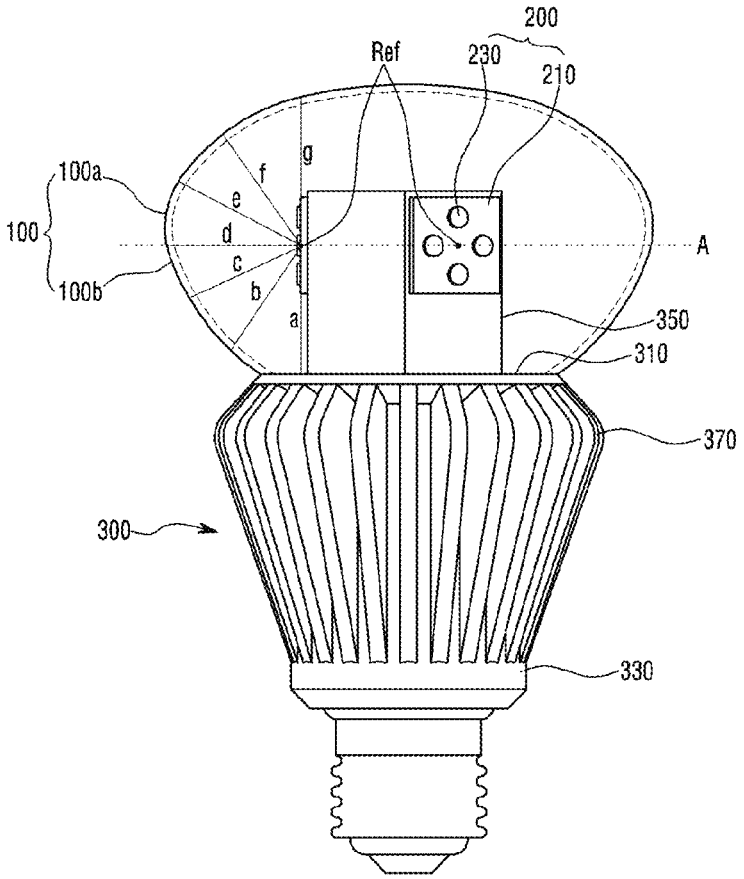
FIG. 6 is a front view of the lighting device shown in FIG. 1.
Figure 7:
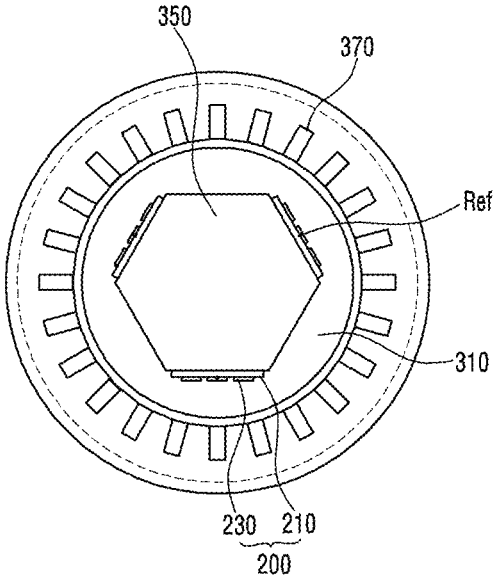
FIG. 7 is a plan view of the lighting device shown in FIG. 1.

FIG. 6 is a front view of the lighting device shown in FIG. 1. FIG. 7 is a plan view of the lighting device shown in FIG. 1.

The cover 100 and the light source 200 may have a predetermined relation. Particularly, the shape of the cover 100 may be determined according to the position of the light source 200. In description of the shape of the cover 100 and the position of the light source 200, a reference point "Ref" is set for convenience of the description. The reference point "Ref" may be a center point among the light emitting devices 230 or a center point of the substrate 210.

The shape of the cover 100 may be determined by a straight line "a" from the reference point "Ref" to the top surface 310 of the heat sink 300 and by six straight lines "b" "c" "d" "e" "f" and "g" from the reference point "Ref" to the cover, specifically, the outer edge of the cover 100. An angle between the straight lines "a" and "g" is 180°. An angle between the straight lines "a" and "d" is 90°. An angle between the straight lines "d" and "g" is 90°. An angle between two adjacent straight lines out of the seven straight lines is 30°.

The following Table 1 shows length ratios of the six straight lines when the length of the straight line "a" is 1.

TABLE 1

| | a (0°) | b (30°) | c(60°) | d(90°) | e(120°) | f(150°) | g(180°) |
|---|---|---|---|---|---|---|---|
| Ratio | 1 | 0.99 ± 0.06 | 0.94 ± 0.06 | 1.06 ± 0.06 | 1.12 ± 0.06 | 1.12 ± 0.06 | 1.21 ± 0.06 |

Referring to FIGS. 6 and 7 and Table 1, the cover 100 may be divided into an upper portion 100*a* and a lower portion 100*b* on the basis of an imaginary plane "A" passing through the center point "Ref" of the light source 200. Here, the imaginary plane "A" is parallel with the top surface 310 of the heat sink 300 and is perpendicular to the side of the member 350.

A distance from the center point "Ref" of the light source 200 to the upper portion 100*a* of the cover 100 is larger than that from the center point "Ref" to the top surface 310 of the heat sink 300. Also, a distance from the center point "Ref" of the light source 200 to the lower portion 100*b* of the cover 100 is less than that from the center point "Ref" to the top surface 310 of the heat sink 300. Also, the distance from the center point "Ref" of the light source 200 to the upper portion 100*a* of the cover 100 is larger than that from the center point "Ref" to the lower portion 100*b* of the cover 100.

As such, the lighting device according to the first embodiment is able to satisfy the Energy Star requirement that at least 5% of the total flux (lm) of a lighting device should be emitted in 135° to 180° zone of the lighting device.

Figure 8:
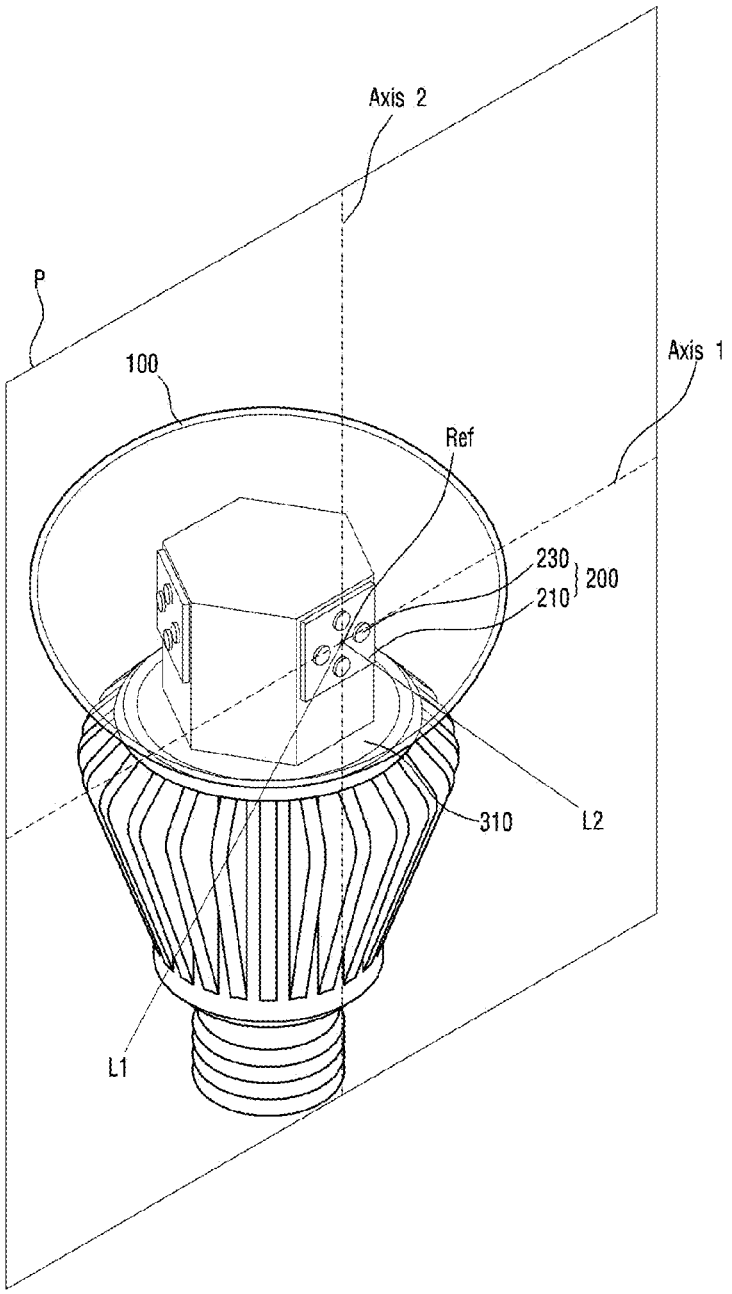
FIG. 8 is a perspective view of the lighting device shown in FIG. 1.
Figure 9:
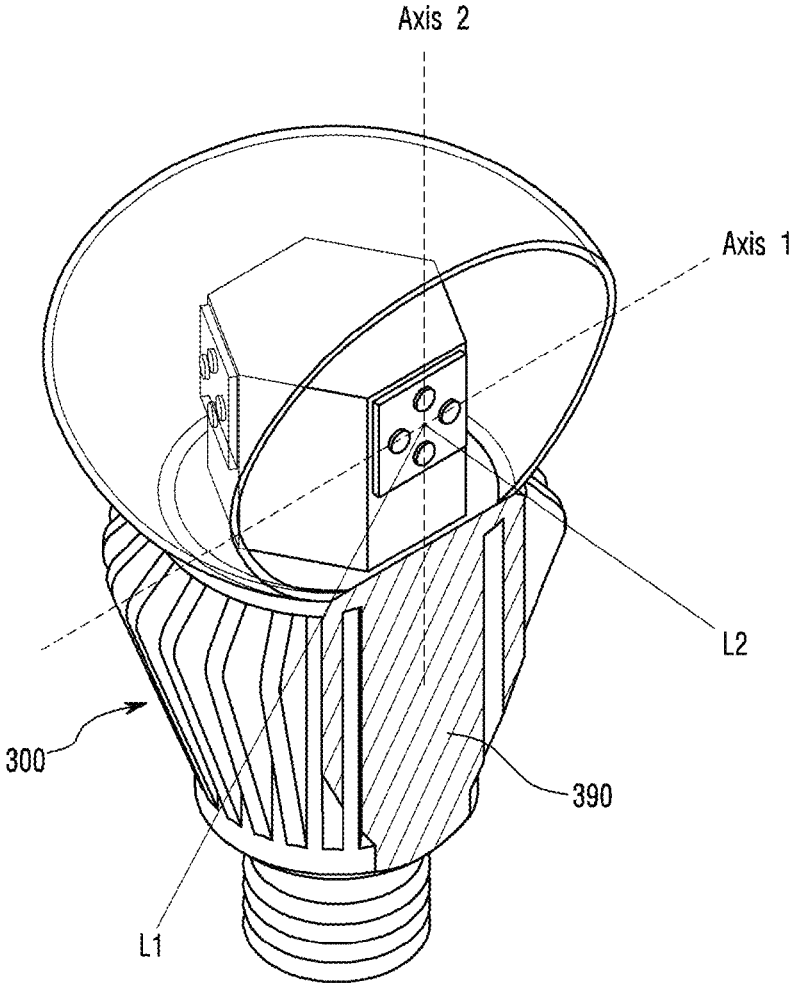
FIG. 9 is a perspective view showing a cross section formed by cutting the lighting device shown in FIG. 8 along the imaginary plane.
Figure 10:
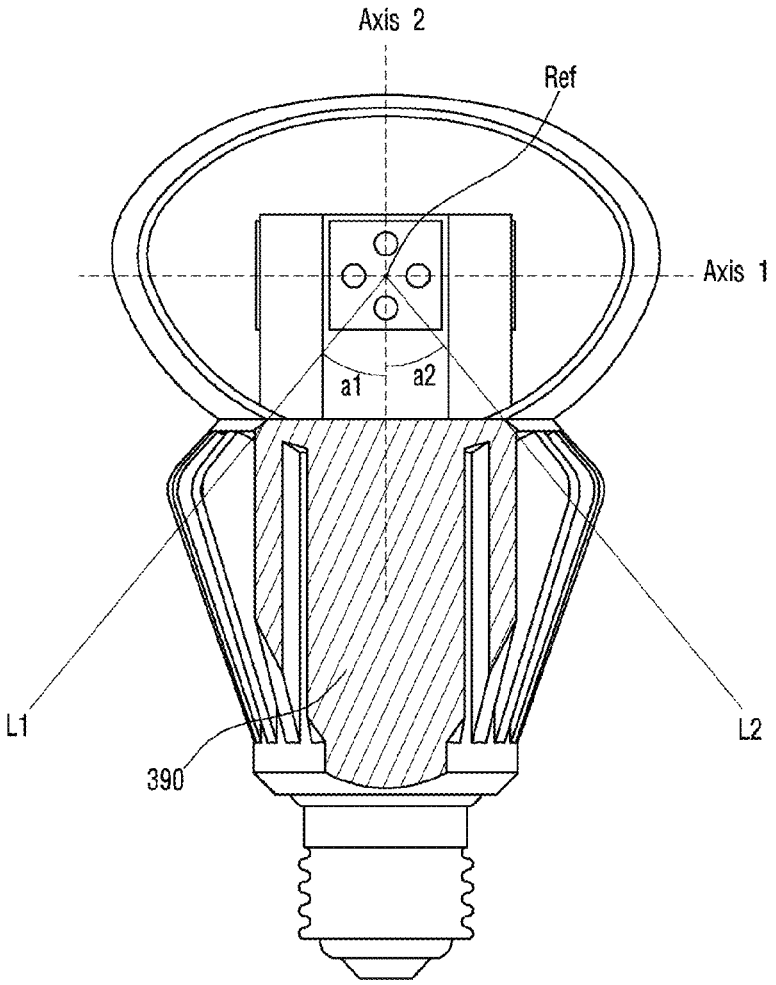
FIG. 10 is a front view of the lighting device shown in FIG. 9.
Figure 11:
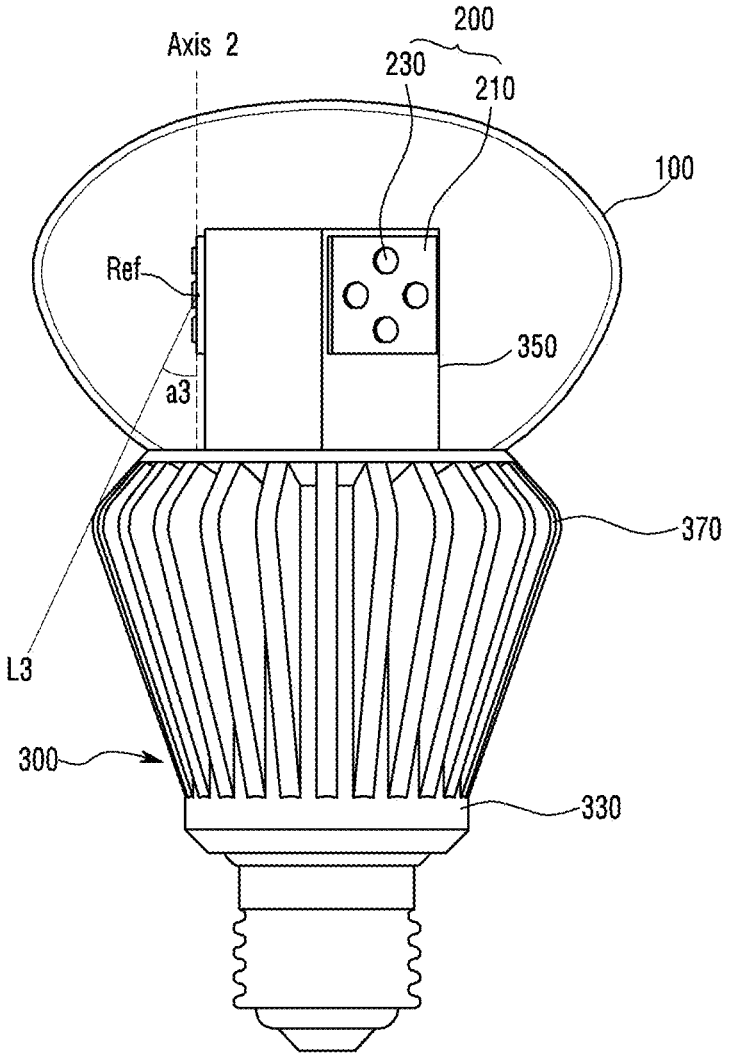
FIG. 11 is a side view of the lighting device shown in FIG. 10.

FIG. 8 is a perspective view of the lighting device shown in FIG. 1. FIG. 9 is a perspective view showing a cross section formed by cutting the lighting device shown in FIG. 8 along the imaginary plane. FIG. 10 is a front view of the lighting device shown in FIG. 9. FIG. 11 is a side view of the lighting device shown in FIG. 10.

The imaginary plane "P" shown in FIG. 8 includes the center point "Ref" of the light source 200 or the substrate 210. Also, the reference point "Ref" includes one side of the substrate 210, on which the light emitting device 230 is disposed.

The imaginary plane "P" has an axis 1 (horizontal axis) and an axis 2 (vertical axis). The axis 1 is parallel with the top surface 310 of the heat sink 300. The axis 2 is perpendicular to the top surface 310 of the heat sink 300.

The imaginary plane "P" includes a first tangent line L1 and a second tangent line L2.

Referring to FIGS. 9 and 10, the heat sink 300 has a cross section 390 caused by the imaginary plane "P" of FIG. 8.

The first tangent line L1 and the second tangent line L2 pass through the center point "Ref" of the light source 200 and contact with the cross section 390 of the heat sink 300.

An angle "a1" formed by the first tangent line L1 and the axis 2 is greater than and not equal to 0° and equal to or less than 45°. An angle "a2" formed by the second tangent line L2 and the axis 2 is greater than and not equal to 0° and equal to or less than 45°.

In FIGS. 9 and 10, it means that the heat radiating fin 370 is disposed below the first tangent line L1 and the second tangent line L2. That is, the heat radiating fin 370 extends from the side 330 of the heat sink 300 to the first tangent line L1 and the second tangent line L2 without passing over the first tangent line L1 and the second tangent line L2. This means that the extended length of the heat radiating fin 370 may be limited by the first tangent line L1 and the second tangent line L2. When the heat radiating fin 370 is disposed below the first tangent line L1 and the second tangent line L2, it is possible to improve rear light distribution characteristic of the lighting device according to the first embodiment.

Here, if the heat sink 300 does not include the heat radiating fins 370, it means that the side 330 of the heat sink 300 is disposed below the first tangent line L1 and the second tangent line L2. In other words, the structure of the side 330 of the heat sink 300 is limited by the first tangent line L1 and the second tangent line L2.

Referring to FIG. 11, a third tangent line L3 passes through the center point "Ref" of the light source 200 and contacts with the heat radiating fin 370 of the heat sink 300.

An angle "a3" between the axis 2 and the third tangent line L3 is greater than and not equal to 0° and equal to or less than 45°. An angle between the side of the member 350 and the third tangent line L3 is greater than and not equal to 0° and equal to or less than 45°.

In FIG. 11, it means that the heat radiating fin 370 is disposed below the third tangent line L3. That is, the heat radiating fin 370 extends from the side 330 of the heat sink 300 to the third tangent line L3 without passing over the third tangent line L3. This means that the extended length of the heat radiating fin 370 may be limited by the third tangent line L3. When the heat radiating fin 370 is disposed below the third tangent line L3, it is possible to improve rear light distribution characteristic of the lighting device according to the first embodiment.

Here, if the heat sink 300 does not include the heat radiating fins 370, it means that the side 330 of the heat sink 300 is disposed below the third tangent line L3. In other words, the structure of the side 330 of the heat sink 300 is limited by the third tangent line L3.

Figure 12:
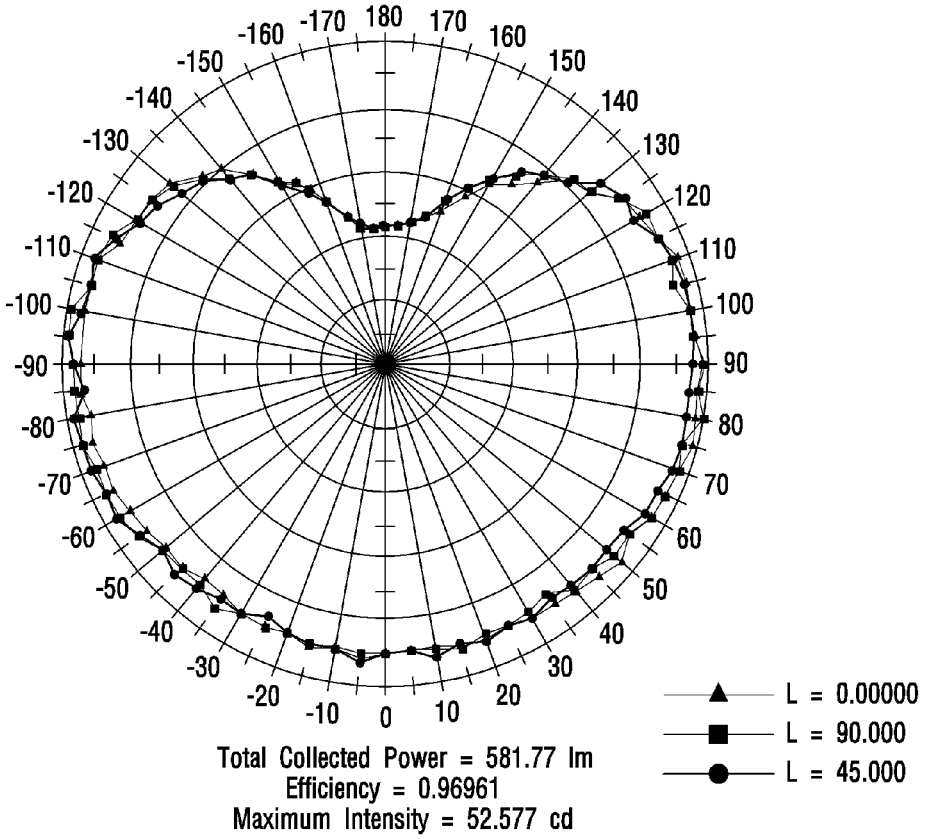
FIG. 12 is a graph showing the luminous intensity distribution of the lighting device shown in FIGS. 1 and 2.

FIG. 12 is a graph showing the luminous intensity distribution of the lighting device shown in FIGS. 1 and 2.

Referring to FIG. 12, it can be found that the lighting device shown in FIGS. 1 and 2 satisfies Energy Star specifications shown in FIG. 5.

Second Embodiment

FIG. 13 is an exploded perspective view of a lighting device according to a second embodiment. FIG. 14 is a front view of the lighting device shown in FIG. 13. FIG. 15 is a plan view of the lighting device shown in FIG. 13. Here, the perspective view of the lighting device according to the second embodiment shown in FIGS. 13 to 15 may be the same as that of the lighting device shown in FIG. 1.

Referring to FIGS. 13 to 15, the lighting device according to the second embodiment may include the cover 100, the light source 200, a heat sink 300', the circuitry 400, the inner case 500 and the socket 600. Here, since the components except for the heat sink 300', that is, the cover 100, the light source 200, the circuitry 400, the inner case 500 and the socket 600 are the same as the cover 100, the light source 200, the circuitry 400, the inner case 500 and the socket 600 according to the first embodiment shown in FIG. 2, the detailed description thereof is replaced by the foregoing description.

The heat sink 300' is coupled to the cover 100 and functions to radiate outwardly the heat from the light source 200.

The heat sink 300' may include the top surface 310, the side 330, the bottom surface (not shown) and a member 350'. Here, since the top surface 310, the side 330 and the bottom surface (not shown) are the same as the top surface 310, the side 330 and the bottom surface (not shown) shown in FIG. 2, the detailed description thereof is replaced by the foregoing description.

The member 350' is disposed on the top surface 310. The member 350' may be integrally formed with the top surface 310 or may be coupled to the top surface 310.

The member 350' may be a polygonal pillar of which a side is inclined at a predetermined angle. The member 350' may be also a cone or a polypyramid.

Specifically, the member 350' may be a hexagonal pillar shape. The hexagonal pillar-shaped member 350 has a top surface, a bottom surface and six sides. Here, an area of the top surface of the member 350' may be less than that of the bottom surface of the member 350'. Each of the six sides forms an acute angle with an imaginary axis perpendicular to the top surface 310. Specifically, an angle between the side and the imaginary axis may be 15°. Also, each of the six sides forms an obtuse angle with the top surface 310. Specifically, an angle between the side and the top surface 310 may be 105°.

The light source 200 may be disposed on the side of the member 350'. Here, the light source 200 may be disposed on all or some of the six sides. Also, at least two light sources 200 may be disposed on the side of the member 350'. The light source 200 disposed on each of three out of the six sides are shown in the drawings.

The lighting device according to the second embodiment has the same effect as that of the lighting device according to the first embodiment. Moreover, in the lighting device according to the second embodiment, the member 350' has the six sides inclined at an acute angle (for example, 15°) with respect to the imaginary axis. Also, the light source 200 is disposed on each of three out of the six sides of the member 350'. Accordingly, it is possible to notably remove dark portion which may be generated in the cover 100 by the draft angle of the light source 200. The dark portion can be more effectively removed by the lighting device according to the second embodiment shown in FIG. 13 than the lighting device according to the first embodiment shown in FIG. 2.

FIG. 16 is a perspective view of a light source shown in FIGS. 2 and 13. FIG. 17 is a side view of the light source shown in FIG. 16. FIG. 18 is a view showing an example of measured values of a lens shown in FIG. 17.

A light source 200' shown in FIGS. 16 to 18 may be the light source 200 shown in FIG. 2 or may be the light source 200 shown in FIG. 13. Therefore, it should be noted that the light source 200' shown in FIGS. 2 and 13 is not limited to the light source 200 shown in FIGS. 16 to 18.

Referring to FIGS. 16 to 18, the light source 200' may include the substrate 210 and a plurality of light emitting devices 220. The substrate 210 is disposed on the side of the member 350 shown in FIG. 2 or on the side of the member 350' shown in FIG. 13. The plurality of light emitting devices 220 are disposed on the substrate 210. In the drawings, the light source 200' is represented with the one substrate 210 and the four light emitting devices 220 which are symmetrically disposed.

Since the substrate 210 and the light emitting device 220 are the same as the substrate 210 and the light emitting device 230 shown in FIG. 2, the detailed description thereof is replaced by the foregoing description.

The light source 200' may be disposed on the substrate 210 and may further include a lens unit 230 disposed on the light emitting device 220.

The lens unit 230 may include a lens 231 having a predetermined beam angle. The lens 231 may be an aspheric lens or a primary lens. Here, the beam angle of the aspheric lens or the primary lens may be greater than 150° or more preferably, 160°.

The lens 231 is able to improve the uniformity of a linear light source of the lighting device according to the first embodiment or the second embodiment by increasing an orientation angle of the light emitted from the light emitting device 220. The lens 231 may have any one shape selected from the group of a concave shape, a convex shape and a hemispherical shape. The lens 231 may be made of an epoxy resin, a silicone resin, a urethane resin or a compound of them. The light source 200' including the lens 231 is able to improve the rear light distribution characteristic of the lighting device according to the first and the second embodiments.

More specifically, the lens unit 230 may include an aspheric lens 231 and a bottom plate 232. The aspheric lens 231 is disposed on the light emitting device 220. The bottom plate 232 is integrally formed with the aspheric lens 231 and is disposed on the substrate 210. Here, the aspheric lens 231 may have a side 231*a* and a curved surface 231*b*. The cylindrical side 231*a* has a cylindrical shape and is formed vertically from the bottom plate 232. The curved surface 231*b* has a hemispherical shape and is disposed on the side 231*a*.

The lens unit 230 may have, as shown in FIG. 18, optimized measured values.

Referring to FIG. 18, the lens 231 may have a circular shape. The rear surface of the lens 231 may be aspheric. The diameter of the lens 231 may be 2.8 mm. The height from the bottom plate 232 to the curved surface 231*b* of the lens 231 may be 1.2 mm. The height from the bottom plate 232 to the side 231*a* of the lens 231 may be 0.507 mm. The diameter of the upper portion of the side 231*a* may be 2.8 mm. The thickness of the bottom plate 232 may be 0.1 mm. Here, the diameter of the upper portion of the side 231*a* may be designed to be larger or less than that of the lens 231 in accordance with the height of the side 231*a*.

Meanwhile, a reflective layer (not shown) may be disposed in the bottom plate 232 of the lens unit 230. The reflective layer (not shown) causes the optical efficiency of the lighting device according to the second embodiment to be more improved. The reflective layer (not shown) may be formed of at least any one selected from the group consisting of metallic materials including Al, Cu, Pt, Ag, Ti, Cr, Au and Ni by deposition, sputtering, plating, printing or the like methods in the form of a single or composite layer.

The lighting device shown in FIG. 13 is also able to satisfy the requirements of ANSI specifications.

FIG. 19 is a front view of the lighting device shown in FIG. 13. FIG. 20 is a plan view of the lighting device shown in FIG. 13.

Referring to FIGS. 19 and 20, the lighting device according to the second embodiment satisfies ANSI specifications. A unit of millimeter (mm) is used in FIGS. 19 to 20.

For the purpose of satisfying ANSI specifications, in the lighting device according to the second embodiment, ratios of the overall height, the height of the cover 100, the diameter of the cover 100, the diameter of the top surface 310 of the heat sink 300', the height of the member 350' and the length of one side of the member 350' may be 7.5~7.6:3.3~3.4:4.5~4.6:2.7~2.8:2.2~2.3:1.

Referring to FIGS. 19 to 20, the lighting device according to the second embodiment has the following measured values. The height from the socket 600 to the cover 100 is 112.7 mm. The height of the cover 100 is 48.956 mm. The diameter of the cover 100 is 67.855 mm. The diameter of the top surface 310 of the heat sink 300' is 40.924 mm. The height of the member 350' is 32.6 mm. The length of the side of the member 350' is 15 mm. Therefore, it can be understood that the lighting device according to the second embodiment satisfies ANSI specifications denoted by an alternated long and short dash line.

In the meantime, it can be seen through the following simulation result that the lighting device according to the second embodiment satisfies Energy Star specifications shown in FIG. 5, particularly, the requirement that at least 5% of the total flux (lm) of the lighting device should be emitted in 135° to 180° zone of the lighting device.

Figure 21:
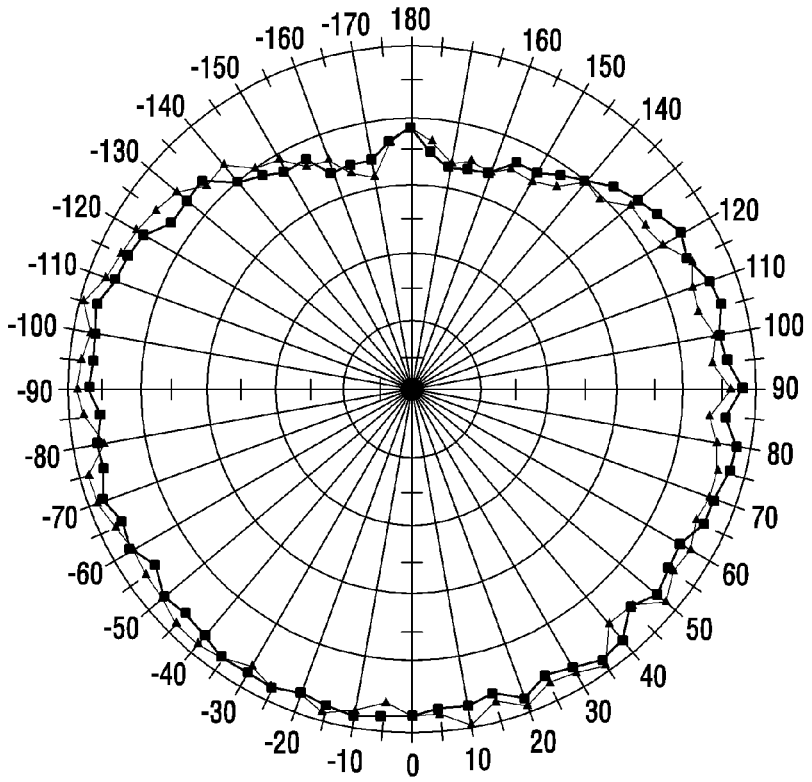
FIG. 21 is a graph showing the simulation result of the luminous intensity distribution of the lighting device according to the second embodiment.

FIG. 21 is a graph showing the simulation result of the luminous intensity distribution of the lighting device according to the second embodiment.

The simulation has been conducted under the condition that an overall power is 667.98 (lm), optical efficiency is 0.89783, and the maximum luminous intensity is 60.698 (cd).

As shown in the simulation result of FIG. 21, the lighting device according to the second embodiment has wholly uniform luminous intensity distribution. As a result, the lighting device satisfies the rear light distribution characteristic required by Energy Star specifications.

Figure 22:
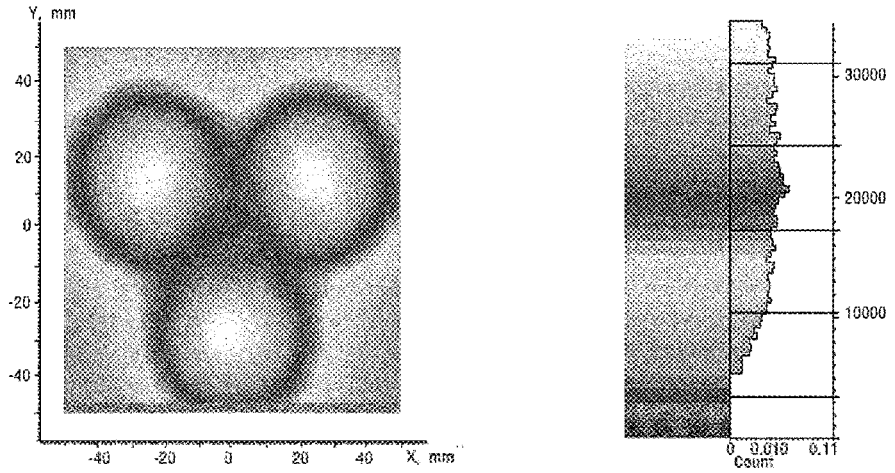
FIG. 22 is a view showing a color coordinate of a conventional lighting device.
Figure 23:
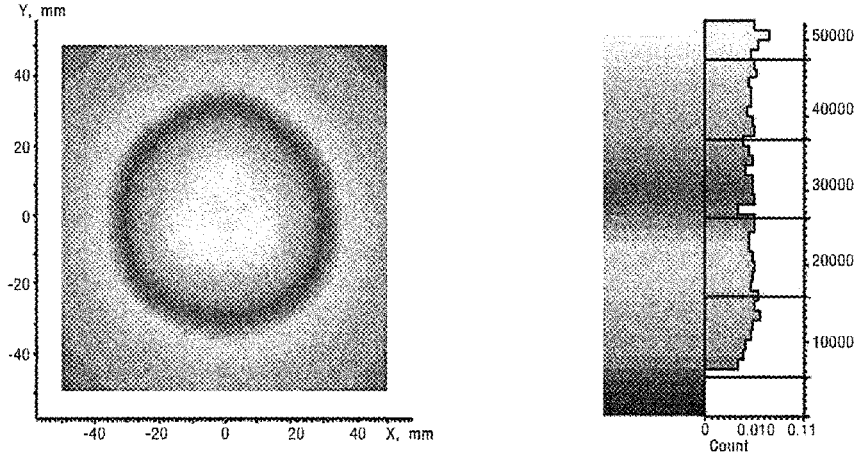
FIG. 23 is a view showing a color coordinate of the lighting device according to the second embodiment.

FIG. 22 is a view showing a color coordinate of a conventional lighting device. FIG. 23 is a view showing a color coordinate of the lighting device according to the second embodiment.

The color coordinate of FIG. 22 is an experimental result of a conventional lighting device without the member 350' and the lens 231 of the lighting device according to the second embodiment. The color coordinate of FIG. 23 is an experimental result of the lighting device according to the second embodiment.

First, as shown in the color coordinate of the FIG. 22, it can be found that the conventional lighting device has the maximum illuminance of 29143.988, a center illuminance of 15463.635, an overall average illuminance of 53.6% and a central dark portion. Contrarily, as shown in the color coordinate of the FIG. 23, it can be found that the lighting device according to the second embodiment has the maximum illuminance of 48505.615, a center illuminance of 42812.934 and an overall average illuminance of 88.26% and has no central dark portion.

Accordingly, as shown in the color coordinates, it can be found through the simulation results that as compared with the conventional lighting device, the lighting device according to the second embodiment has remarkably improved rear light distribution characteristic and notably reduced dark portion.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lamp, comprising:

an optically transmissive enclosure having an opening formed in a lower portion with an empty interior;

a heat sink including:

a base member to couple to the optically transmissive enclosure, the base member including a first surface that is a top surface proximate to the optically transmissive enclosure, a member protruding into the empty interior of the optically transmissive enclosure from the first surface of the base member in a first direction into the optically transmissive enclosure, the first direction being perpendicular to the first surface of the base member, the member including a top surface and at least one of a side surface being between the top surface of the member and the first surface of the base member, wherein at least one of the side surface of the member includes a first region and a second region, wherein the first region is perpendicular to the first surface of the base member and locates higher than a one-third point of a first distance, wherein the second region locates lower than a one-third point of the first distance, wherein the first distance is a vertical height from the first surface of the base member to the top surface of the member, and a heat radiation fins extended outwardly from a side surface of the base member in a second direction perpendicular to the first direction;

a light source on the first region of at least one of the side surface of the member, wherein the second region of at least one of the side surface of the member exclude the light source;

a socket to supply electric power to the light source;

a circuitry disposed between the light source and the socket; and a case comprising a portion between the heat radiation fins and the circuitry, wherein the portion of the case, the heat radiation fins and the circuitry are horizontally overlapped, wherein a center point of the light source is within a range of 28% to 59% of a second distance, wherein the second distance is a shortest distance in a first direction from the first surface of the base member to a uppermost surface of the optically transmissive enclosure, wherein an angle between the first region of at least one of the side surface of the member and an imaginary tangent line passing from the center point of the light source to an outermost point of the heat radiation fins in the second direction is less than 45 degrees, and wherein a largest width of the optically transmissive enclosure in the second direction larger than a largest width of the heat sink in the second direction.

2. The lamp according to claim 1, wherein the first surface contacts an edge of the side surface of the member.

3. The lamp according to claim 1, wherein the light source comprises a substrate and a light emitting device disposed on the substrate.

4. The lamp according to claim 3, wherein an area of at least one of the side surface of the member is one and a half times larger than an area of a top surface of the substrate of the light source.

5. The lamp according to claim 1, wherein a total number of the side surface of the member is equal to or greater than six.

6. The lamp according to claim 1, wherein the optically transmissive enclosure is coupled to the first surface of the base member by an adhesive material.

7. The lamp according to claim 1, wherein the optically transmissive enclosure includes an opaque material.

8. The lamp according to claim 3, wherein the light source including a plurality of light emitting devices.

9. The lamp according to claim 3, wherein the substrate is a printed circuit board.

10. The lamp according to claim 1, wherein the case comprises a plastic or resin material.

11. The lamp according to claim 1, wherein the case is received in the space of the base member.

12. The lamp according to claim 3, wherein the substrate includes a first edge and a second edge, the second edge of the substrate closer to the first surface of the base member than the first edge, and the first edge of the substrate being opposite to the second edge of the substrate, wherein the member includes a one-third point and a two-thirds point of the first distance, and wherein the second edge of the substrate locates higher than the one-third point of the first distance from the first surface of the base member.

13. The lamp according to claim 12, wherein the center point of the light source locates higher than the two-thirds point of the first distance from the first surface of the base member.

14. The lamp according to claim 12, wherein the center point of the light source is closer to the top surface of the member than to the first surface of the base member.

15. The lamp according to claim 2, further comprising a connection member electrically connecting the light source with the circuitry, wherein the connection member is disposed within the heat sink.

16. A lamp, comprising:

an optically transmissive enclosure having an opening formed in a lower portion with an empty interior;

a heat sink including:

a base member to couple to the optically transmissive enclosure, the base member including a first surface that is a top surface proximate to the optically transmissive enclosure, a member protruding into the empty interior of the optically transmissive enclosure from the first surface of the base member in a first direction into the optically transmissive enclosure, the first direction being perpendicular to the first surface of the base member, the member including a top surface and at least one of a side surface being between the top surface of the member and the first surface of the base member, wherein at least one of the side surface of the member includes a first region and a second region, wherein the first region is perpendicular to the first surface of the base member and locates higher than a one-third point of a first distance, wherein the second region locates lower than a one-third point of the first distance, wherein the first distance is a vertical height from the first surface of the base member to the top surface of the member, and a heat radiation fins extended outwardly from a side surface of the base member in a second direction perpendicular to the first direction;

a light source on a the first region of at least one of the side surface of the member, wherein the second region of at least one of the side surface of the member exclude the light source;

a socket to supply electric power to the light source;

a circuitry disposed between the light source and the socket; and a case comprising a portion having a closed loop shape surrounding a portion of the circuitry, wherein the portion of the case, the heat radiation fins and the portion of the circuitry are horizontally overlapped, wherein a center point of the light source disposed on the first region, wherein an angle between the first region of at least one of the side surfaces of the member and an imaginary tangent line passing from the center point of the light source to an outermost point of the heat radiation fins in the second direction is less than 45 degrees, and wherein a largest width of the optically transmissive enclosure in the second direction larger than a largest width of the heat sink in the second direction.

17. The lamp according to claim 16, wherein the first surface contacts an edge of the side surface of the member.

18. The lamp according to claim 16, wherein the light source comprises a substrate and a light emitting device disposed on the substrate.

19. The lamp according to claim 18, wherein the substrate includes a first edge and a second edge, the second edge of the substrate closer to the first surface of the base member than the first edge, and the first edge of the substrate being opposite to the second edge of the substrate, wherein the member includes a one-third point and a two-thirds point of the first distance, and wherein the second edge of the substrate locates higher than the one-third point of the first distance from the first surface of the base member.

20. The lamp according to claim 19, wherein the center point of the light source locates higher than the two-thirds point of the first distance from the first surface of the base member.

* * * * *